United States Patent [19]

Dubrovsky

[11] 4,402,362

[45] Sep. 6, 1983

[54] PLATE HEAT EXCHANGER

[76] Inventor: Evgeny V. Dubrovsky, ulitsa Chaikovskogo, 18, kv. 203, Moscow, U.S.S.R.

[21] Appl. No.: 253,935

[22] PCT Filed: Jul. 9, 1979

[86] PCT No.: PCT/SU79/00053

§ 371 Date: Mar. 9, 1981

§ 102(e) Date: Mar. 9, 1981

[87] PCT Pub. No.: WO81/00148

PCT Pub. Date: Jan. 22, 1981

[30] Foreign Application Priority Data

May 19, 1977 [SU] U.S.S.R. ..... 2484829

[51] Int. Cl.[3] ..... F28F 3/06

[52] U.S. Cl. ..... 165/166

[58] Field of Search ..... 165/166, 167

[56] References Cited

U.S. PATENT DOCUMENTS

| | | | |
|---|---|---|---|
| 3,079,994 | 3/1963 | Küehl | 165/166 |
| 3,229,763 | 1/1966 | Rosenblad | 165/166 |
| 3,313,343 | 4/1967 | Ware et al. | 165/166 |
| 3,768,149 | 10/1973 | Swaney, Jr. | 165/166 |

FOREIGN PATENT DOCUMENTS

| | | | |
|---|---|---|---|
| 145527 | 3/1952 | Australia | 165/166 |
| 1371493 | 7/1964 | France | 165/141 |
| 1104542 | 11/1961 | Fed. Rep. of Germany | 165/165 |
| 827063 | 2/1960 | United Kingdom | 165/166 |
| 1367471 | 9/1974 | United Kingdom . | |

*Primary Examiner*—Sheldon J. Richter

*Attorney, Agent, or Firm*—Lilling & Greenspan

[57] ABSTRACT

A plate heat exchanger has a corrugated heat exchange surface whose corrugations are arranged in rows displaced relative to one another through half the pitch of the corrugation. Fins of each corrugation include three portions. Extreme portions are made rectilinear and are disposed at the crest and base at an equal angle to an axis of symmetry of the corrugation. Middle portions rigidly connect the fins of the corrugations arranged in adjacent rows. The middle portion of the fins of each corrugation of the heat exchange surface includes two portions made in the form of arcs of an equal radius and arranged so that the radii of curvature are directed toward one another. A rigid connection of the fins of corrugations is accomplished at mating points of the arc-shaped portions.

The plate heat exchanger may find application in engineering objects of automotive, aviation, power engineering, refrigerating, chemical and other industries.

4 Claims, 4 Drawing Figures

PLATE HEAT EXCHANGER

FIELD OF THE INVENTION

The invention relates to heat engineering and more particularly to plate heat exchangers.

DESCRIPTION OF THE PRIOR ART

Used as heat exchange surfaces in heat exchangers of the known designs are corrugated heat exchange surfaces formed by passages whose cross-sections are of rectangular and complex trapezoidal profiles and provided with short fins in the direction of flow of a heat carrying medium. From the thermohydraulic standpoint, the most effective mechanism of the heat exchange intensification is realized in the design of corrugated surfaces of this type. When a heat carrying medium flows in the regime characterized by the relationship: $Re > Re_c$, where Re is the Reynolds number and $Re_c$ is the critical value of the Reynolds number at which the initial loss of stability occurs in the laminar structure of flow of the heat carrying medium, the separation of the heat carrying medium and generation of vortex systems take place in passages of the corrugated surface at the edges of corrugation fins. The vortex systems are commensurate in scale with half the thickness of the corrugation fins and are disposed in a wall boundary layer of the flow at a distance from the wall being commensurate with half the thickness of the fins. Thus the additional energy applied to the flow of heat carrying medium for intensification of the convective heat exchange in the passages of such a surface is spent only for turbulization of the wall boundary layer of the heat carrying medium, but not for turbulization of the flow core.

As a consequence, in a narrow wall boundary layer of a passage, in which the main thermal resistance to heat emission is concentrated, the value of turbulent conductivity and the value of heat flux density are small in magnitude. However, the presence of a vortex system in the wall boundary layer sharply increases the value of turbulent viscosity which leads to a rise in the value of turbulent conductivity and, consequently, to a rise in the value of heat flux density. As a result, these passages when compared with plane passages ensure a high value of the heat extraction coefficient at a moderate increase in consumption of energy for intensification of the convective heat exchange. Accordingly, the aforementioned makes it possible to substantially decrease the volume, mass and the cost of heat exchangers employing the heat exchange surface of such a type.

However, the decrease in the volume and mass of the plate heat exchangers is ensured not only by a highly effective process of intensification of the convective heat exchange realized in the passages of their heat exchange surfaces, but also by the use of highly compact designs of the plate heat exchange surfaces. The known designs of heat exchange surfaces with short fins in the direction of flow of the heat carrying medium do not feature high values of the surface compactness.

Well known in the art is a plate heat exchanger (cf. e.g., French Pat. No. 1,371,493, Cl. F 28d, Sept. 28, 1963), which employs a corrugated heat exchange surface formed by short fins arranged in the direction of flow of the heat carrying medium, corrugations being of rectangular shape. The corrugations are provided with flat crests. The corrugations following in the direction of flow of the heat carrying medium are displaced relative to the preceding ones through half the pitch of the corrugations. The corrugations arranged in succession are rigidly connected to one another through the flat crests.

Thus, there is formed a junction of a rectangular profile having sides equal to the thickness of the corrugation material and to half the base of the corrugation flat crest.

The design of a plate heat exchange surface heretofore described does not ensure the maximum possible compactness which is attained in the surfaces formed by triangular passages.

The surface formed by passages with a cross-section in the shape of an equilateral triangle has twice as great a value of the compactness.

There is also known a plate heat exchanger (cf., e.g., FRG Pat. No. 1,104,542, Oct. 2, 1956), comprising a corrugated heat exchange surface, the fins of corrugations thereof being formed by upper and lower rectilinear portions inclined at an equal angle to the axis of symmetry of the corrugation, and by intermediate portions. The intermediate portions rigidly connect the corrugations arranged in succession in the direction of flow of the heat carrying medium and displaced relative to one another through half the pitch of the corrugation. Passages of the heat exchange surface have a cross-section of a complex trapezoidal profile.

However, the presence of an intermediate portion on the fins of the corrugations, made in the form of a flat plate having a width commensurate wih the corrugation pitch, does not ensure a sufficiently high value of the heat exchange surface compactness. In addition, the presence of flat crests of the corrugations commensurate with the corrugation pitch also reduces the maximum possible value of the compactness for the heat exchange surface of this design.

As the effectiveness of heat exchanger designs is characterized not only by the thermohydraulic effectiveness of the process of heat exchange intensification relized in the passages of the heat exchange surface, but also by the degree of compactness of the heat exchange surface, the considered design does not ensure a high effectiveness of the heat exchangers employing this design.

The considered corrugated surface of a plate heat exchanger does not possess resistance to the compression imposed on the corrugations of the corrugated surface in the designs of heat exchangers operating with a counterpressure in the cavities thereof. This is explained by the fact that the intermediate flat portions are made in a cantilever form and are mating with the upper and lower portions of the corrugations at acute angles.

SUMMARY OF THE INVENTION

It is an object of the present invention to provide a plate heat exchanger in which the construction of fins of a corrugated heat exchange surface would ensure the decrease of volume and mass thereof.

This object is accomplished by a plate heat exchanger with a corrugated heat exchange surface, the corrugations of which are arranged in rows displaced relative to one another through half the pitch of the corrugation. Fins of each corrugation comprise three portions of which the extreme ones are rectilinear and disposed at the crest and the base at an equal angle to the axis of symmetry of the corrugation, and middle portions are rigidly connected with the fins of corrugations disposed in adjacent rows. According to the invention, the middle portion of fins of each corrugation of the heat exchange surface comprises two arc-shaped portions with an equal radius of curvature, arranged so that the radii of curvature are directed toward one another, the rigid connection of the fins of the corrugations being accomplished at mating points of the arc-shaped portions.

It is preferable that, in order to improve the compactness of a plate heat exchanger, according to the invention, the radius of curvature of the arc-shaped portions of the fins of each corrugation should equal from 0.1 to 3.0 corrugation heights.

It is also preferable that, in order to improve the compactness of a plate heat exchanger, according to the invention, the distance between the extreme portions of the fin of each of the corrugations, disposed at the base of the corrugation in a plane passing through the mating points of the two arc-shaped portions of the fins of the corrugation, should equal from 1.05 to 3.0 distances between the extreme portions of the fin of each of the corrugations, disposed at the crest of the corrugation in the same plane.

The use of the proposed plate heat exchangers makes it possible to substantially decrease the volume, mass and the cost of plate heat exchangers, retaining high fabrication properties for series and mass production.

BRIEF DESCRIPTION OF THE DRAWINGS

Other objects and advantages of the present invention will be readily apparent from the following description of a plate heat exchanger taken in conjunction with the accompanying drawings, in which.

DETAILED DESCRIPTION OF THE INVENTION

Figure 1:
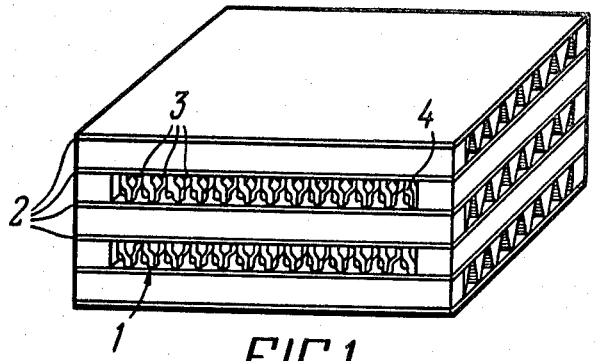
FIG. 1 is an isometric representation of a plate heat exchanger with corrugated heat exchange surfaces, according to the invention.

A corrugated surface 1 (FIG. 1) of the plate heat exchanger is disposed between separating plates 2 plated with solder on both sides. Crests 3 of corrugations 4 of the corrugated heat exchange surface 1 are soldered to said separating plates 2.

The proposed corrugated surface of a plate heat exchanger may be readily used in plate-and-fin heat exchangers of any design intended for different applications.

Figure 2:
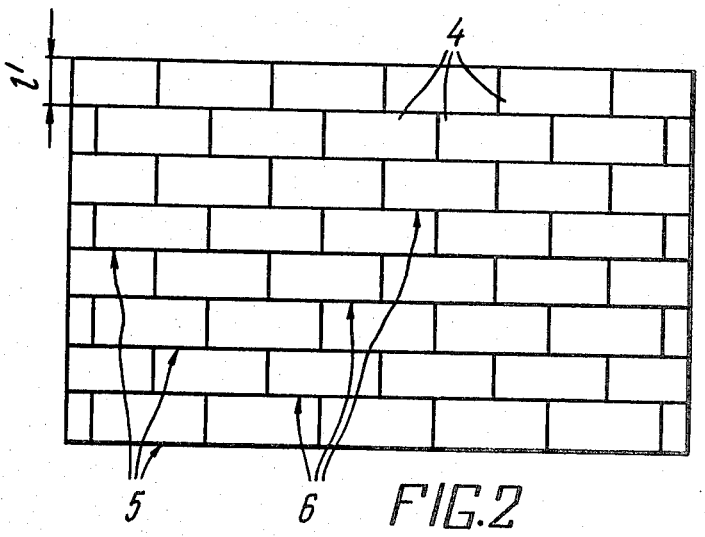
FIG. 2 is a top view of a corrugated heat exchange surface, according to the invention.
Figure 3:
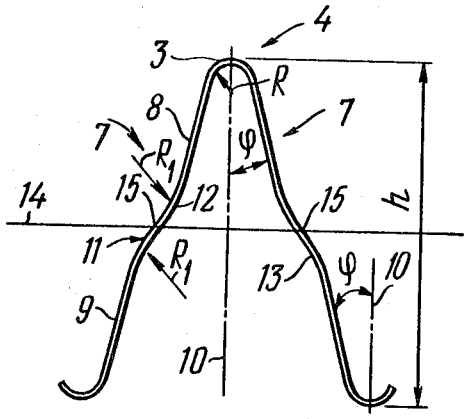
FIG. 3 is a cross-section of a corrugation of a corrugated surface, according to the invention.

The corrugated surface 1 (FIG. 2) of the plate heat exchanger comprises rows 5 and 6 of the corrugations 4 arranged in succession one after another. The corrugations 4 arranged in succession are displaced relative to one another through half the pitch t of the corrugation 4. In each of the rows 5 and 6 the corrugations 4 form short uninterrupted passages of a length l' in the direction of flow of a heat carrying medium. The cross-section of each corrugation 4 (FIG. 3) has a complex triangular form defined by fins 7 of the corrugation 4. The fins 7 of the corrugations 4 are formed by extreme rectilinear portions 8 disposed at the crest 3 of the corrugations 4, and extreme rectilinear portions 9 disposed at the base of the corrugations 4. The extreme portions 8 and 9 of the fins 7 have an equal angle of inclination l to an axis 10 of symmetry of the corrugations 4. The rectilinear portions 8 of the fins 7 of the corrugations 4 are mating a the crest 3 of the corrugation 4 having a radius R. A middle portion 11 is disposed between the rectilinear portions 8 and 9 of the fins 7. The middle portion 11 of the fins 7 is formed by two arc-shaped portions 12 and 13 having an equal radius $R_1$ of curvature and arranged so that the radii of curvature are directed toward one another. The distance between the extreme rectilinear portions 9 of the fins 7 of each corrugation 4 in a plane 14 passing through mating points 15 of the two arc-shaped portions 12 and 13 of the fins 7 of the corrugation 4 is greater than the distance between the extreme rectilinear portions 8 of the fins 7 of the corrugation 4 in the same plane 14.

Figure 4:
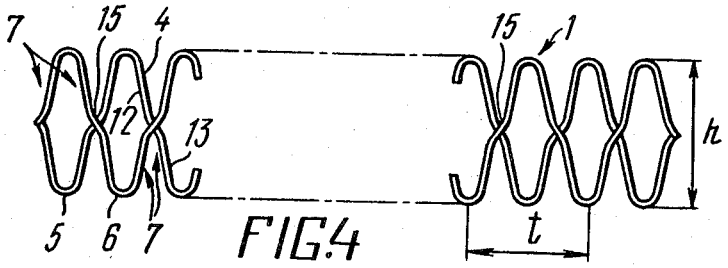
FIG. 4 is a cross-section of a corrugated surface according to the invention.

A rigid connection of the corrugations 4 (FIG. 4) which are arranged in succession is accomplished at the mating points of the arc-shaped portions 12 and 13 disposed on the fins 7 of the corrugations 4 at a distance equal to one half the height h of the corrugation 4.

The rigid connection is effected on a portion having the form of a rectangle with sides approximately equal to the thickness of a material of the corrugation 4.

For improving the compactness of the corrugated surface 1 (FIG. 3) the radius $R_1$ of the arcs of the arc-shaped portions 12 and 13 of the fins 7 of each corrugation 4 should equal from 0.1 to 3.0 times the height h of the corrugation 4.

For further improving the compactness of the corrugated surface 1 the distance between the extreme portions 9 of the fin 7 of each of the corrugations 4 disposed at the base of the corrugation 4 measured in the plane 14 passing through the mating points 15 of the two arc-shaped portions 12 and 13 of the fins 7 of the corrugation 4 should equal from 1.05 to 3.0 times the distance between the extreme portions 8 of the fin 7 of each of the corrugations 4 disposed at the crest of the corrugation 4 in the same plane 14.

The described plate heat exchanger operates in the following manner.

When two gaseous heat carrying media are flowing in a plate heat exchanger, the heat from a warmer heat carrying medium through the fins 7 (FIG. 2) of the corrugations 4 of the corrugated surface 1 of one of the cavities of the flat heat exchanger and through the soldered crests 3 (FIG. 1) of the corrugations 4 is rejected to the separating plates 2. From the separating plate 2 the heat is transferred to a colder heat carrying medium through the fins 7 of the corrugations 4 whose crests 3 are soldered to the other side of the separating plate 2.

When the heat carrying medium flows through the passages of the corrugated heat exchange surface 1, vortex systems are generated on edges of the fins 7 of the corrugations 4; these vortex systems are disposed in a wall boundary layer of the flowing heat carrying medium and are commensurate in scale with the thickness of the wall boundary layer. By a carrying stream the vortices are taken away in the direction of flow along the fins 7 of the corrugations 4, gradually dissipating on the walls. Owing to the small length of the passages in the corrugations 4, the vortices have no time to damp out and are generated again in the subsequent passages of the corrugations 4. The hydrodynamic situation across the section of the corrugation 4 is not similar. At the portion of cross-section of the passages of the corrugations 4 defined by the extreme rectilinear portions 8 of the fins 7, the generated vortex systems are damping out at a greater rate along the flow of the heat carrying medium than at the portion of cross-section of the corrugations 4 defined by the extreme rectilinear portions 9 of the fins 7, as the extreme rectilinear portions 8 of the fins 7 are arranged closer to one another than the extreme rectilinear portions 9. As a result, at the portion of cross-section of the corrugation 4 defined by the extreme rectilinear portions 8 of the fins 7, the flow of the heat carrying medium changes more readily into a laminar flow due to a close disposition or a confluence of the adjacent laminar boundary layers. This causes a more rapid damping out of the vortex systems on the walls of the rectilinear portions 8 of the fins 7 when compared with the conditions existing on the walls of the extreme rectilinear portions 9 of the fins 7.

Due to the fact that the mating of the extreme rectilinear portions 8 and 9 of the fins 7 of the corrugations 4 is accomplished at the arc-shaped portions 12 and 13, the hydrodynamic situation across the section of the corrugations 4 heretofore described is changing not intermittently, but gradually.

The best results in the intensification of the convective heat exchange in the passages of the heat exchange surface 1 of the proposed design are achieved at a value of the radius of arcs of the arc-shaped portions 12 and 13 of the fins 7 of each corrugation 4 being equal to 0.1–3.0 times the height h of the corrugation 4.

The lesser difference in the hydrodynamic structure of flow across the section of the corrugation 4, giving favorable results, and the improvement of compactness of the corrugated surface 1 are achieved by reducing the difference between the distance of the extreme portions 9 of the fin 7 of each of the corrugations 4 disposed at the base of the corrugation 4 measured in the plane passing through the mating points 15 of the two arc-shaped portions 12 and 13 of the fins 7 of the corrugations 4 and the distance between the extreme portions 8 of the fins 7 of each of the corrugations 4 disposed at the crest 3 of the corrugation 4 in the same plane 14. The best results in the intensification of the convective heat exchange in the passages of the corrugated surface 1 of the proposed design with simultaneous improvement in the compactness thereof are attained in those cases when the distance between the extreme portions 9 of the fins 7 of each of the corrugations 4 disposed at the base of the corrugation 4 measured in the plane 14 passing through the mating points 15 of the two arc-shaped portions 12 and 13 of the fins 7 of the corrugation 4 equals from 1.0 to 3.0 times the between the extreme portions 8 of the fin 7 of each of the corrugations 4 disposed at the crest 3 of the corrugation 4 in the same plane 14.

The use of the proposed corrugated surface in the design of a plate heat exchanger frequently operating under conditions of $K \approx \alpha_{min}$ (where K is the heat transfer coefficient of the heat exchanger and $\alpha_{min}$ is the minimum heat extraction coefficient of one of the two heat exchange surfaces of the heat exchanger) provides a decrease in the volume, mass and the cost of the heat exchanger by 25–30 percent when compared with the use of similar corrugated heat exchange surfaces of the known designs.

Industrial Applicability

The plate heat exchanger may be used in gas-to-gas, liquid-to-gas and liquid-to-liquid heat exchangers of different applications, and also in air-cooled condensers and evaporators for condensation and evaporation of various fluids, employed in engineering objects of automotive, aviation, power engineering, refrigerating, chemical and other industries.

I claim:

1. A plate heat exchanger with a corrugated heat exchange surface, the corrugations of which are arranged in rows displaced relative to one another through half the pitch of the corrugation, and fins of each corrugation comprise three portions of which the extreme portions are rectilinear and disposed at the crest and the base at an equal angle to the axis of symmetry of the corrugation, and middle portions are rigidly connected with the fins of the corrugations disposed in adjacent rows, wherein the improvement comprises said middle portion of the fins of each corrugation of the heat exchange surface comprising two arc-shaped portions with equal radii of curvature arranged so that the radii of curvature are directed toward one another, the rigid connection of the fins of the corrugations being accomplished at mating points of the arc-shaped portions at a point having the form of a rectangle with sides approximately equal to the thickness of a material of the corrugation.

2. A plate heat exchanger according to claim 1, wherein the radius of curvature of the arc-shaped portions of the fins of each corrugation equals from 0.1 to 3.0 times the height of the corrugation.

3. A plate heat exchanger according to claim 1 wherein the distance between extreme portions of the fins of each of the corrugations, disposed at the base of the corrugation in a plane passing through the mating points of the two arc-shaped portions of the fins of the corrugation, equals from 1.05 to 3.0 times the distance between extreme portions of the fins of each of the corrugations, disposed at the crest of the fin in the same plane.

4. A plate heat exchanger according to claim 2, wherein the distance between extreme portions of the fins of each of the corrugations, disposed at the base of the corrugation in a plane passing through the mating points of the two arc-shaped portions of the fins of the corrugation, equals from 1.05 to 3.0 times the distance between extreme portions of the fins of each of the corrugations, disposed at the crest of the fin in the same plane.

* * * * *